US007040270B2

(12) United States Patent
Herdin et al.

(10) Patent No.: US 7,040,270 B2
(45) Date of Patent: May 9, 2006

(54) INTERNAL COMBUSTION ENGINE

(75) Inventors: Günther Herdin, Jenbach (AT); Johann Klausner, St. Jakob i.H. (AT)

(73) Assignee: GE Jenbacher GmbH & Co oHG, Jenbach (AT)

( * ) Notice: Subject to any disclaimer, the term of this patent is extended or adjusted under 35 U.S.C. 154(b) by 180 days.

(21) Appl. No.: 10/349,058

(22) Filed: Jan. 21, 2003

(65) Prior Publication Data

US 2003/0136366 A1 Jul. 24, 2003

(30) Foreign Application Priority Data

Jan. 22, 2002 (AT) ..... A 100/2002

(51) Int. Cl.
*F02P 23/00* (2006.01)

(52) U.S. Cl. ..... 123/143 B; 123/260; 372/23

(58) Field of Classification Search ..... 123/260, 123/143 B; 372/23, 25, 71
See application file for complete search history.

(56) References Cited

U.S. PATENT DOCUMENTS

| | | | | | |
|---|---|---|---|---|---|
| 4,235,517 | A | * | 11/1980 | Marie | 359/345 |
| 4,314,530 | A | | 2/1982 | Giacchetti | 123/143 R |
| 4,434,753 | A | * | 3/1984 | Mukainakano et al. | 123/143 B |
| 4,523,552 | A | * | 6/1985 | Mukainakano et al. | 123/143 B |
| 4,726,336 | A | * | 2/1988 | Hoppie et al. | 123/292 |
| 4,852,529 | A | | 8/1989 | Vowles | |
| 5,883,746 | A | * | 3/1999 | Zelenka | 359/629 |
| 5,983,871 | A | * | 11/1999 | Gordon et al. | 123/536 |
| 6,302,682 | B1 | | 10/2001 | Early et al. | 431/1 |
| 6,382,957 | B1 | * | 5/2002 | Early et al. | 431/1 |
| 6,413,077 | B1 | * | 7/2002 | Early et al. | 431/1 |
| 6,514,069 | B1 | * | 2/2003 | Early et al. | 431/1 |
| 6,554,986 | B1 | * | 4/2003 | Mathies et al. | 204/452 |
| 6,601,560 | B1 | * | 8/2003 | Serve | 123/260 |

FOREIGN PATENT DOCUMENTS

| | | |
|---|---|---|
| AT | 002 623 | 1/1999 |
| DE | 3400034 A1 | 1/1984 |
| EP | 1 063 427 | 12/2000 |
| JP | 09042138 A | 2/1997 |
| JP | 10 122115 | 5/1998 |
| JP | 10196508 A | 7/1998 |

* cited by examiner

*Primary Examiner*—John T. Kwon
(74) *Attorney, Agent, or Firm*—Lorusso Loud & Kelly LLP

(57) ABSTRACT

Internal combustion engine with at least one cylinder, in which the combustion of a homogeneous air/fuel mixture compressed in the cylinder by a piston is initiated by a time-controlled external ignition, the air/fuel ratio of the air/fuel mixture in the combustion chamber (25) being greater than 1.9 and, for the time-controlled external ignition, at least one laser light source (10), at least one optical transmission apparatus (11) and at least one coupling optic (12) for the focussing of laser light into a combustion chamber (25) being provided.

53 Claims, 4 Drawing Sheets

INTERNAL COMBUSTION ENGINE

BACKGROUND OF THE INVENTION

The invention relates to an internal combustion engine with at least one cylinder, in which the combustion of a homogeneous air/fuel mixture compressed in the cylinder by a piston is initiated by a time-controlled external ignition.

Such engines are called Otto engines in the literature. They can for example be designed as carburettor Otto engines, injection Otto engines or gas Otto engines, the latter being powered by a fuel that is gaseous in its normal state. In Otto engines, a homogeneous air/fuel mixture (variation of the air/fuel ratio lambda over the combustion chamber of less than 10%) is ignited via an external ignition means, usually a spark plug. Above all in stationary gas engines with ever higher specific performance values it has been shown that the lives of the spark plugs are not of satisfactory length. Attempts have therefore been made to increase the lives by applying coatings of noble metals, for example platinum alloys. This has also proved successful in some cases, but overall the life values are still not yet satisfactory. The fact that the electrode spacing has to be adjusted after a specific period of operation in spark plugs is also disadvantageous. This requires the switching off of the internal combustion engine.

Furthermore, it is known to run engines in lean mode, i.e. with a air/fuel mixture ratio lambda which lies well above the stoichiometric air/fuel ratio of lambda=1. Typical lambda values of such lean engines with a homogeneous air/fuel mixture in the case of natural gas are of the order of 1.4 to 1.7. In the most favourable case, values of up to 1.8 are possible. To reduce emissions of pollutants, in particular the $NO_x$ levels in the exhaust gases, a higher lambda value, thus a leaner mixture, would be advantageous. Tests by the applicant and the pertinent literature (for example "Internal Combustion Engine Fundamentals", John B. Heywood, McGraw Hill Book Company, 1988, pages 403 and 426) clearly show, however, that with a spark ignition via spark plugs lean mixtures with a lambda value of more than roughly 1.7 are not ignitable in an internal combustion engine (Otto engine) with a homogeneous air/fuel mixture.

SUMMARY OF THE INVENTION

To avoid these problems it is proposed according to the invention that the air/fuel ratio of the air/fuel mixture in the combustion chamber is greater than 1.9 and that, for the time-controlled external ignition, at least one laser light source, at least one optical transmission apparatus and at least one coupling optic for the focussing of laser light into a combustion chamber are provided.

Tests by the applicant have shown that with a laser ignition instead of the previous spark ignition via spark plugs even very lean mixtures with a air/fuel ratio lambda of more than 1.9 are reliably ignitable. The ignition of air/fuel mixtures by means of laser ignition is already known per se. Surprisingly, however, tests by the applicant have shown that it is by laser ignition that the existing prejudice of the specialists, that lean air/fuel mixtures with a lambda value of more than 1.7 cannot be externally ignited, can be overcome. Thus, for the first time, an externally ignited, very lean Otto engine became possible which, in addition to a low fuel consumption, is also characterized by very low emission values, in particular $NO_x$ values.

Tests by the applicant have shown that laser ignition can even be reliably ignited with very lean air/fuel mixtures with a lambda value of more than 2 and even more than 2.1. Such lean engines preferably represent the versions of the invention.

A variant of the invention resides in the fact that, for the time-controlled external ignition, at least one laser light source, at least one optical transmission apparatus and at least one coupling optic for the focussing of laser light into a combustion chamber are provided, and the piston of at least one cylinder has a piston trough and at least one focus of the laser light lies in the piston trough in the upper dead center position of the piston. The laser ignition allows the ignition site of the air/fuel mixture to be laid "deeper" into the combustion chamber, in particular into the piston trough. It has been shown that this has a favourable effect on ignitability.

Surprisingly, it was shown that the ignition energy of the laser pulse or pulses used for an ignition procedure can lie below 20 mJ (millijoules) and with an optimal ignition site even below 3 mJ. This in turn permits the use of very cost-favourable lasers, for example a diodepumped solid-state laser, in particular a Nd/YAG laser. It is even possible to use laser diodes direct as laser light sources for the ignition laser pulse.

While previous considerations tended to focus the laser light beam down as much as possible, in order to achieve a high spatial energy density, tests by the applicant have again shown that a finite beam cross-section, not tending towards zero, of the laser light beam in the focus is advantageous. A roughly bell-shaped lateral intensity distribution with a half-width value of the order of between 20 μm and 300 μm, preferably between 40 μm and 100 μm, is particularly advantageous. Contrary to earlier expectations, it is thus thoroughly advantageous if the intensity half-value lies above 40 μm, which can easily be achieved by a suitable coupling optic.

For the ignition of particularly lean air/fuel mixtures (above all with large-capacity stationary gas engines) it is advantageous if, for the time-controlled external ignition, at least one laser light source, at least one optical transmission apparatus and at least one coupling optic for the focussing of laser light into a combustion chamber are provided, and, for the ignition of the air/fuel mixture in a cylinder two or more laser light beams with a spatially staggered focus position are provided. Through this measure, a reliable ignition can be achieved even with relatively slowly spreading flame fronts in lean air/fuel mixtures.

It is already known in principle with Otto engines to use two or more ignition pulses per working stroke for ignition at various sites. A multiple ignition has not yet been used, however, in stationary lean-gas engines. Tests by the applicant have shown that outstanding results can be achieved with such a double or multiple ignition in lean engines. It is to be presumed that the good ignition properties in the case of this variant are due to the fact that the first laser pulse brings about a dissociation of the fuel portions in components which are then more readily ignitable by the second or further laser pulses.

In any case, this double or multiple ignition also permits a direct intensity adjustment if the cylinder pressure of every cylinder is actively recorded and fed to a regulating apparatus. Using the cylinder pressure, it is in fact easy to establish whether the first laser pulse has already led to ignition. If this is the case, the second and any further laser pulses can remain at a standard level. But if the first laser pulse has not led to an ignition, which is reflected in a smaller rise in cylinder pressure, the engine control means or the regulator provided therein can immediately increase the intensity and optionally the duration of the second laser pulse in order to still achieve a reliable ignition during this working stroke.

BRIEF DESCRIPTION OF THE SEVERAL VIEWS OF THE DRAWING

Further advantages and details of the invention will be explained in more detail with the help of the following description of the Figures.

DETAILED DESCRIPTION OF THE INVENTION

Figure 1:
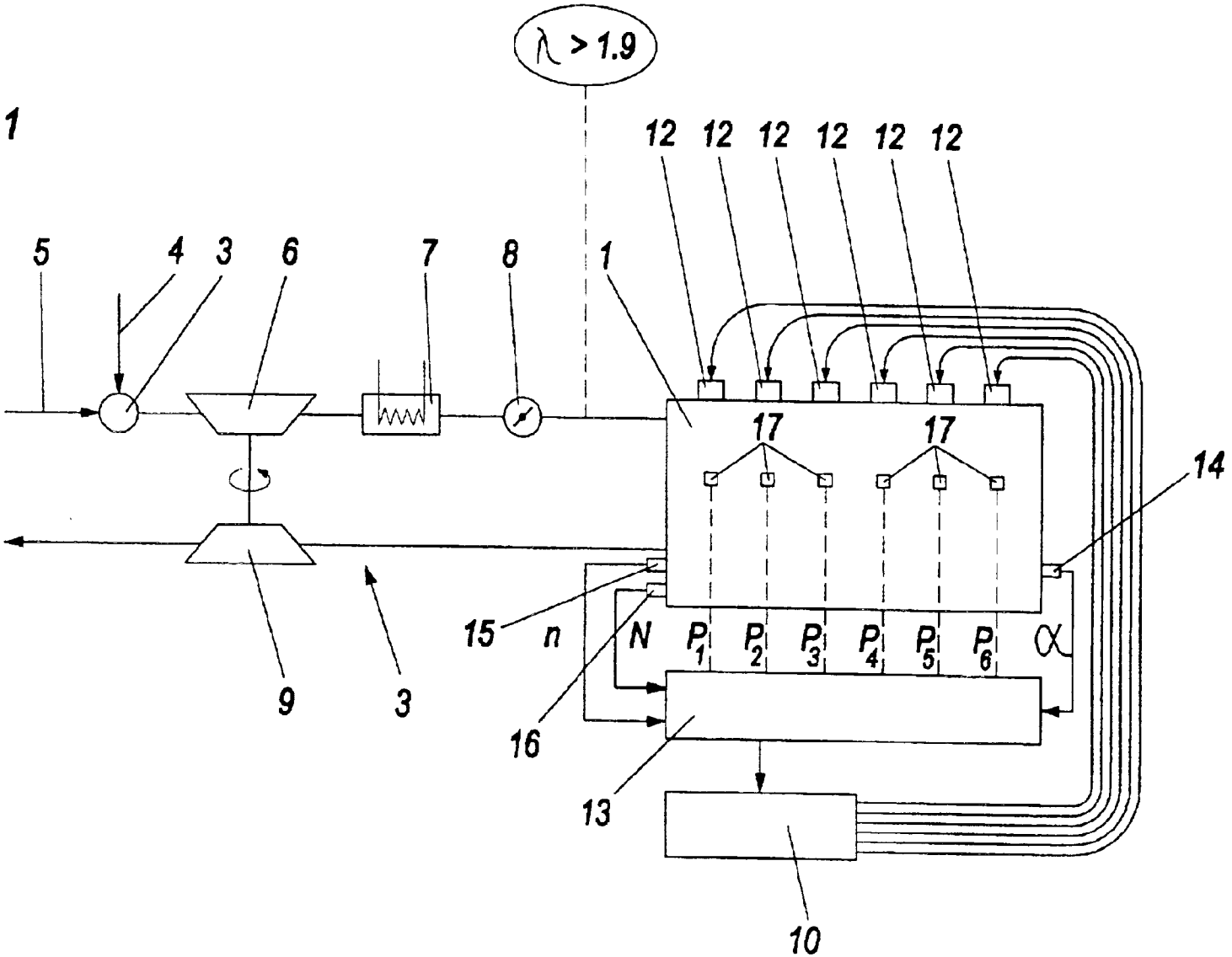
FIG. 1 shows a diagram of an embodiment of an internal combustion engine according to the invention.

The internal combustion engine represented in FIG. 1 is a six-cylinder stationary gas Otto engine 1 with an inlet duct 2 and an exhaust duct 3. In a gas mixer 3, gas fed via the line 4, for example methane, is mixed with air fed via the line 5. Instead of a customary gas mixer, a nozzle can also be used to feed gas into an air line. The gas/air mixture is compressed via the turbocharger/compressor 6 and passes via the mixture cooler 7 and the throttle valve 8 into the chamber in front of the inlet valves, not shown in detail, of the engine 1. The turbine wheel 9 of the turbocharger is arranged in the exhaust line 3. In this respect the engine arrangement corresponds to the state of the art.

The novel feature is that the engine represented in FIG. 1 is run with a air/fuel ratio lambda ($\lambda$) of more than 1.9 and laser ignition means are provided for ignition. These laser ignition means comprise a laser light source generally numbered 10, an optical transmission apparatus consisting of flexible optical conductors 11 in the present embodiment and a coupling optic 12, schematically represented, for each of the six cylinders. This coupling optic essentially consists of a focussing lens or lens arrangement and a combustion chamber window via which the light can enter the combustion chamber from outside. The laser light source 10 is operated from an electronic engine control device 13 which receives, from the angle indicator 14, a crank angle value $\alpha$, and the schematically represented recorders or measurement apparatuses 15 and 16, values which correspond to the engine power N or the speed n. The electronic engine control device also receives values for the current cylinder pressure, which is recorded via recorders 17. The cylinder pressure values are designated P1 to P6. For the chronological establishment of the laser ignition pulses to the individual cylinders, it is above all the crankshaft angle signal that is used, as is already known per se with spark ignition systems.

Each cylinder can be provided with its own laser in the laser light source 10. However, it is also possible to operate with a single laser and divide up the laser light beams for the individual cylinders, for example by beam splitters or rotating mirrors.

Diode laser-pumped solid-state lasers, such as for example YB lasers or Nd/YAG lasers, can be provided as laser light sources for one or more cylinders. These laser light sources can comprise an actively or passively Q-switched laser in order to permit a precisely timed triggering. The wavelength of the laser light used lies more advantageously above 400 nm, preferably above 800 nm, i.e. in the infrared range. Other wavelengths are perfectly conceivable and possible, however.

It has been shown that it is sufficient if the ignition energy of the laser pulse used for an ignition process lies below 20 mJ, preferably below 5 mJ. With a lean mode of operation, it is even possible to manage with ignition energies of below 3 mJ given optimal focus position and intensity distribution. The pulse duration of the individual laser light pulse advantageously lies between 1 ns and 100 ns, preferably between 5 ns and 50 ns. This also permits the use of laser diodes which provide the ignition laser pulse direct as against merely pumping one solid-state laser.

Figure 2:
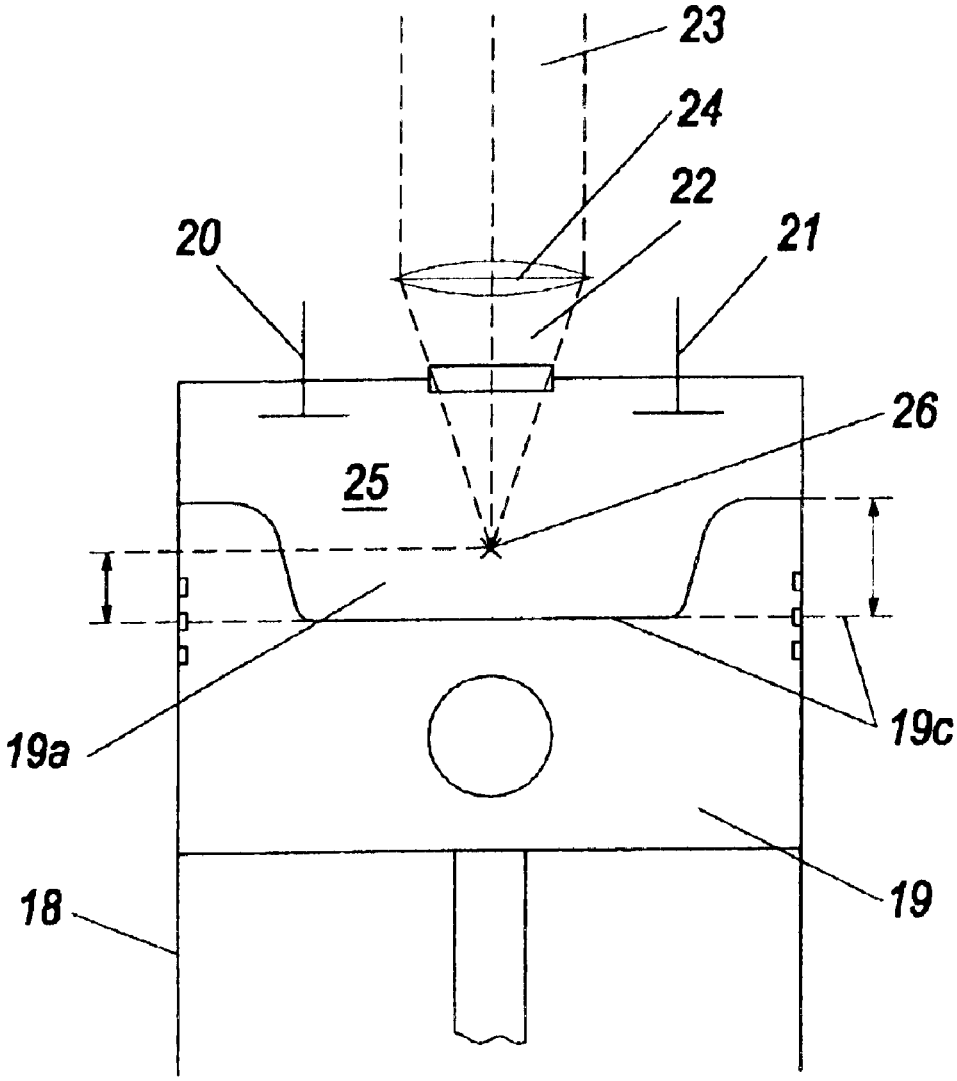
FIG. 2 shows a design variant of a cylinder of an internal combustion engine according to the invention, in a schematic longitudinal section.

Referring now to FIG. 2, a second embodiment will be explained in more detail. A piston 19 is represented in upper dead center position in the cylinder 18. The piston 19 has a piston trough 19*a* of a depth t between the top edge 19*b* and the bottom 19*c* of the piston trough. The inlet valve 20 and the outlet valve 21 are only represented schematically, because they correspond to the state of the art. The piston can also have a combustion chamber disk or a recess which extends as far as the cylinder sleeve. In the case of such a recess, for example running in annular manner around a nose, the piston trough "lies outside".

Instead of the previous spark plug, a combustion chamber window 22 preferably made of sapphire is now provided via which the laser beam 23, after focussing via the lens 24, is introduced into the combustion chamber 25 as a triggered laser ignition pulse.

As FIG. 2 shows, the combustion chamber 25 is an prechamber-less main combustion chamber in which the focus 26 of the laser light lies.

More precisely, the focus 26 of the laser light lies in the piston trough 19*a* of the piston 19, at a distance a which is between 25% and 75% of the trough depth d. Because of this spatial position of the focus well inside the combustion chamber, a good ignition is achieved even with lean air/fuel mixtures above a lambda value of 1.9.

Figure 3:
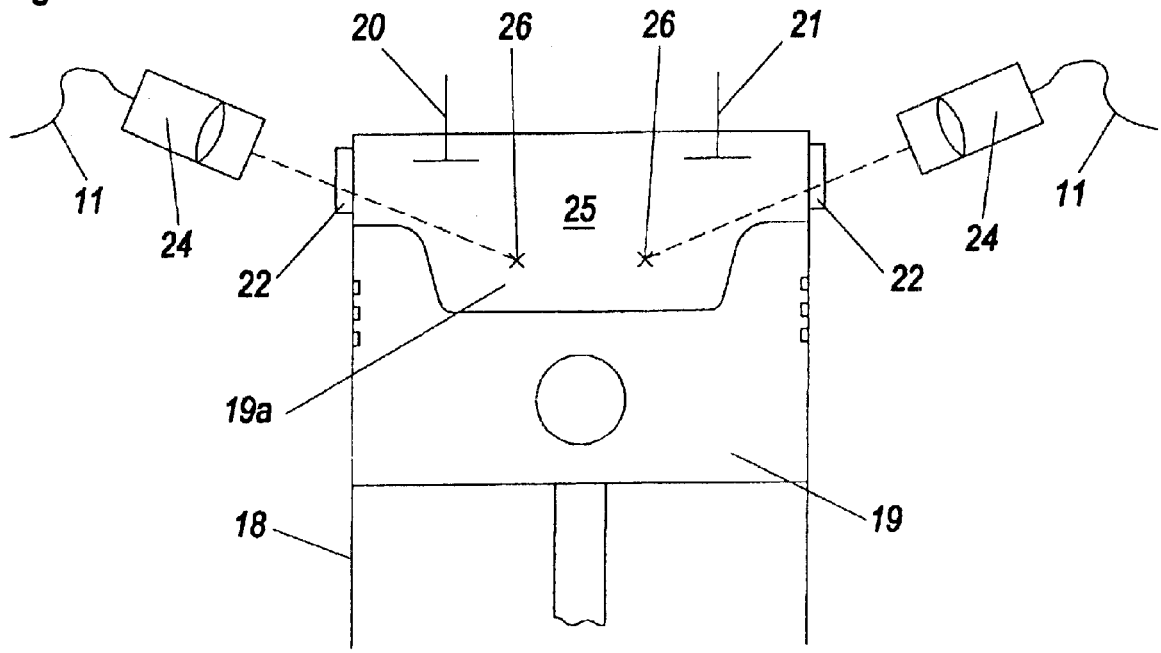
FIG. 3 shows the same representation as FIG. 2 for a different embodiment.

FIG. 3 shows a different version with two combustion chamber windows 22 and two coupling optics 24 which each focus a laser light pulse fed via the light-conducting phase 11 at spatially staggered points (focus 26) into the combustion chamber. In this embodiment, there are thus two spatially separated ignition sites, which leads to an improved ignition above all with very lean air/fuel mixtures and large-volume engines. The two laser light pulses can come from the same laser light source or the same laser. However, it is also possible to use separate lasers. These two laser light pulses can also be used in time-staggered manner for ignition during one and the same working stroke or to initiate same.

The laser ignition also permits, through the possible small combustion chamber window, a lateral access to the combustion chamber (e.g. normal relative to the cylinder axis).

The coupling optic can contain one or more lenses 24. However, it is also possible to design the combustion chamber window 22 itself as a lens.

As already mentioned at the outset, it is advantageous if the coupling optic does not focus the laser light beam down to a maximally small beam cross-section. Rather, it has proved more favourable if the maximum intensity half-width value, measured across the direction of the beam, of the laser light beam in the focus lies between 20 μm and 300 μm, preferably between 40 μm and 100 μm.

Figure 4A:
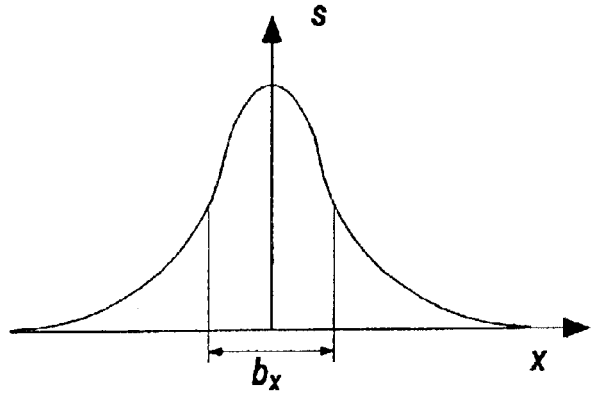
FIGS. 4*a* and 4*b* show the intensity pattern of the laser light beam in the focus in a first direction X perpendicular to the laser light beam and in a second perpendicular to direction X in direction Y.
Figure 4B:
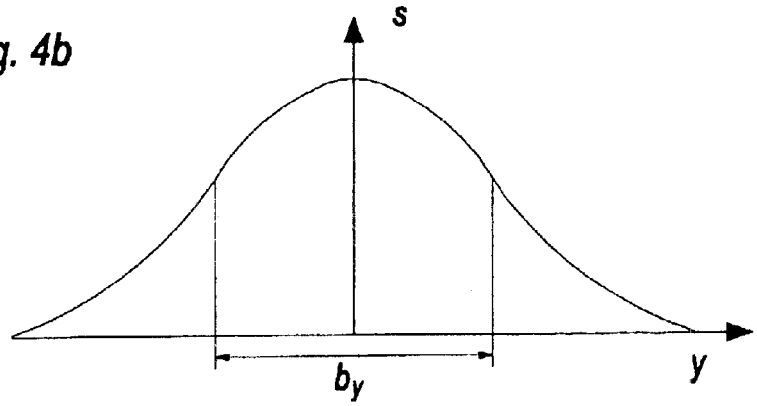

FIGS. 4*a* and 4*b* show the intensity distribution into the two directions X and Y lying perpendicular to each other and both perpendicular to the direction of the beam. These FIGS. 4*a* and 4*b* show that the intensity half-width values in the directions X and Y, namely the values $B_x$ and $B_y$, are different. However, both lie advantageously in the range mentioned above. In any case it is preferable if the intensity half-width values $B_x$ and $B_y$ lie above 40 μm. An intensity distribution that is bell-shaped in the cross-section profile, as roughly shown in FIGS. 4*a* and 4*b*, has likewise proved advantageous.

Figure 5:
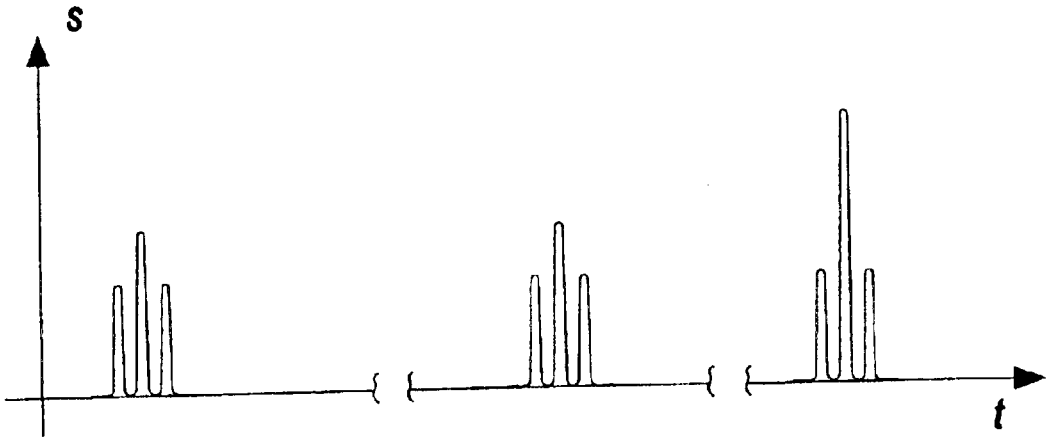
FIG. 5 shows the pattern over time of the laser light intensity in the case of a regulated triple ignition per working stroke.

FIG. 5 shows a chronological sequence of laser ignition pulses for ignition or initiation of successive working strokes, 3 laser light pulses of different levels being used at short time intervals per ignition procedure. A reliable ignition can also be achieved from very lean air/fuel mixtures through such a time-staggered multiple ignition. Such a multiple ignition also permits a real-time adjustment of the laser light intensity via the cylinder pressure, in such a way that if the first laser light pulse does not lead to an ignition (which can be recognized from a flatter rise in the measured cylinder pressure) the intensity of the second laser light pulse is increased, as is shown in the third ignition pulse group in FIG. 5 on the right. The increased light intensity then leads to a reliable ignition of the air/fuel mixture. The laser light energy can thus be minimized while still achieving a reliable ignition. This is of great advantage in respect of costs and the life of the components used.

Figure 6:
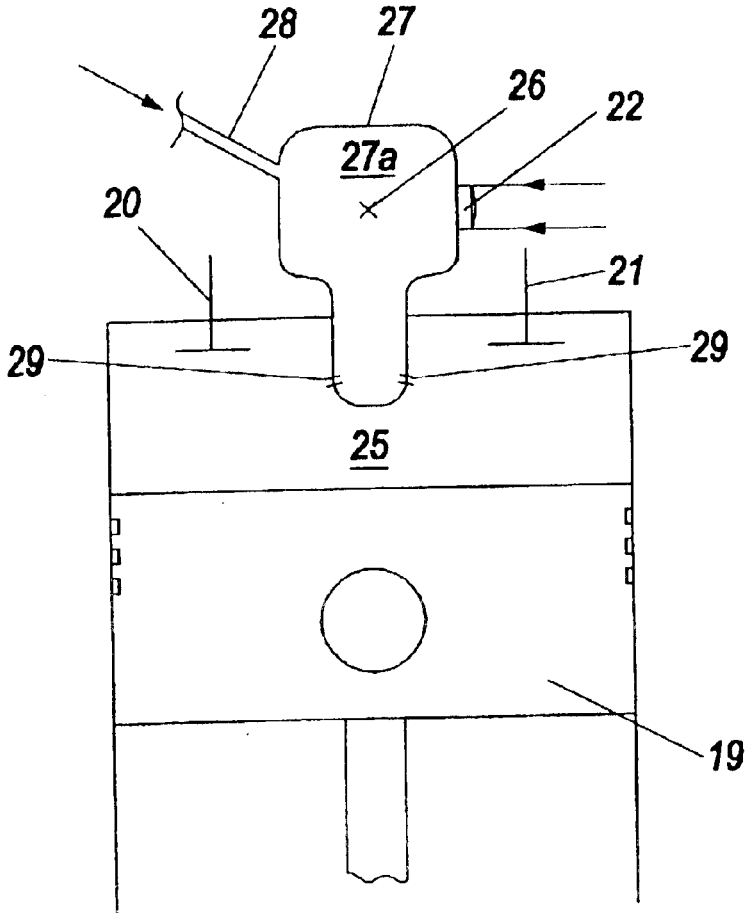
FIG. 6 shows an embodiment of the internal combustion engine according to the invention with reference to a cylinder with an prechamber.

FIG. 6 shows that the laser ignition according to the invention can also be used in an internal combustion engine with an prechamber.

The prechamber is numbered 27. It can, but need not, have a separate fuel feed (gas line 28). The prechamber has, in customary manner, an prechamber combustion space 27*a* which is connected to the main combustion chamber 25 via overflow openings 29. The focus 26 of the laser light coupled from the side via the combustion chamber window developed in the form of a lens lies in the center of the prechamber combustion space 26.

The laser ignition according to the invention is suitable not just for stationary gas engines but also for (mobile) gasoline engines or (mobile) gas engines.

The laser ignition is also suitable for the new combustion concepts of the HCCI (Homogeneous Compressed Charge Ignition) diesel engine where they can preferably be used as an ignition indicator.

What is claimed is:

1. An internal combustion engine with at least one cylinder, in which the combustion of a homogeneous air/fuel mixture compressed in the cylinder by a piston is initiated by a time-controlled external ignition, wherein the air/fuel ratio of the air/fuel mixture in the combustion chamber is greater than 1.9, and, for the time-controlled external ignition, at least one laser light source, at least one optical transmission apparatus and at least one coupling optic for the focusing of laser light into a combustion chamber are provided.

2. The internal combustion engine according to claim 1, wherein each cylinder has a main combustion chamber, with inlet and outlet valves, at least one focus of the laser light lying in the main combustion chamber.

3. An The internal combustion engine according to claim 1, wherein for the time-controlled external ignition, at least one laser light source, at least one optical transmission apparatus and at least one coupling optic for the focusing of laser light into a combustion chamber are provided, and the piston of at least one cylinder has a piston trough and at least one focus of the laser light lies in the piston trough in the upper dead center position of the piston.

4. The internal combustion engine according to claim 3, wherein the distance (a) of at least one focus of the laser light from the bottom of the piston trough lies between 25% and 75% of the trough depth (d).

5. The internal combustion engine according to claim 1, wherein each cylinder has a prechamber into which a separate fuel feed optionally opens and the prechamber combustion space of which is connected via overflow openings to the main combustion chamber, at least one focus of the laser light lying in the prechamber combustion space and the air/fuel ratio in the main combustion chamber or in the prechamber combustion space lying above 1.9.

6. The internal combustion engine according to claim 1, wherein the engine is a multi-cylinder carburetor Otto engine, an injection Otto engine or a gas Otto engine powered with fuel that is gaseous in its normal state.

7. The internal combustion engine according to claim 1, wherein it is a stationary engine.

8. The internal combustion engine according to claim 1, wherein the laser light source has a solid-state laser.

9. The internal combustion engine according to claim 8, wherein the solid-state laser is pumped by a diode laser.

10. The internal combustion engine according to claim 8, wherein the solid-state laser is a Yb laser.

11. The internal combustion engine according to claim 8, wherein the solid-state laser is an Nd laser.

12. The internal combustion engine according to claim 8, wherein the solid-state laser is an Nd/YAG laser.

13. An internal combustion engine with at least one cylinder, in which the combustion of a homogeneous air/fuel mixture compressed in the cylinder by a piston is initiated by a time-controlled external ignition wherein a laser light source has at least one laser diode for direct generation of laser light pulses used for the external ignition.

14. The internal combustion engine according to claim 1, wherein the laser light source comprises at least one laser diode the light of which enters the combustion chamber via a flexible optical conductor and a coupling optic.

15. The internal combustion engine according to claim 13, wherein the laser light source comprises at least one laser diode the light of which enters the combustion chamber via a flexible optical conductor and a coupling optic.

16. The internal combustion engine according to claim 1, wherein the laser light source comprises an actively or passively Q-switched laser.

17. The internal combustion engine according to claim 1, wherein the wavelength of the laser light lies above 400 nm.

18. The internal combustion engine according to claim 13, wherein the wavelength of the laser light lies above 400 nm.

19. The internal combustion engine according to claim 1, wherein for the time-controlled external ignition, at least one laser light source, at least one optical transmission apparatus and at least one coupling optic for the focusing of laser light into a combustion chamber are provided, and the ignition energy of the laser pulse or pulses used for an ignition process lies below 20 mJ.

20. The internal combustion engine according to claim 19, wherein the ignition energy of the laser light pulse or pulses used for an ignition process lies below 5 mJ.

21. An internal combustion engine with at least one cylinder, in which the combustion of a homogeneous air/fuel mixture compressed in the cylinder by a piston is initiated by a time-controlled external ignition, wherein the ignition energy of the laser light pulse or pulses used for an ignition process lies below 3 mJ.

22. The internal combustion engine according to claim 1, wherein the pulse duration of a laser light pulse lies between 1 ns and 100 ns.

23. The internal combustion engine according to claim 13, wherein the pulse duration of a laser light pulse lies between 1 ns and 100 ns.

24. The internal combustion engine according to claim 1, wherein the pulse duration of a laser light pulse lies between 5 ns and 50 ns.

25. The internal combustion engine according to claim 13, wherein the pulse duration of a laser light pulse lies between 5 ns and 50 ns.

26. An internal combustion engine with at least one cylinder, in which the combustion of a homogeneous air/fuel mixture compressed in the cylinder by a piston is initiated by a time-controlled external ignition, wherein for the time-controlled external ignition, at least one laser light source, at least one optical transmission apparatus and at least one coupling optic for the focusing of laser light into a combustion chamber are provided, and the intensity half-width value (bx, by) measured across the direction of the beam of the laser light beam in the focus lies above 40 μm.

27. An internal combustion engine with at least one cylinder, in which the combustion of a homogeneous air/fuel mixture compressed in the cylinder by a piston is initiated by a time-controlled external ignition, wherein for the time-controlled external ignition, at least one laser light source, at least one optical transmission apparatus and at least one coupling optic for the focusing of laser light into a combustion chamber are provided, and the intensity half-width value (bx, by) measured across the direction of the beam of the laser light beam in the focus lies between 20 μm and 300 μm.

28. The internal combustion engine according to claim 27, wherein the intensity half-width value (bx, by) measured across the direction of the beam of the laser light beam in the focus lies between 40 μm and 100 μm.

29. The internal combustion engine according to claim 1, wherein the coupling optic comprises a combustion chamber window and a lens or a lens arrangement outside the combustion chamber for focusing laser light through the combustion chamber window into the combustion chamber.

30. The internal combustion engine according to claim 13, wherein the coupling optic comprises a combustion chamber window and a lens or a lens arrangement outside the combustion chamber for focusing laser light through the combustion chamber window into the combustion chamber.

31. The internal combustion engine according to claim 26, wherein the coupling optic comprises a combustion chamber window and a lens or a lens arrangement outside the combustion chamber for focusing laser light through the combustion chamber window into the combustion chamber.

32. The internal combustion engine according to claim 27, wherein the coupling optic comprises a combustion chamber window and a lens or a lens arrangement outside the combustion chamber for focusing laser light through the combustion chamber window into the combustion chamber.

33. The internal combustion engine according to claim 29, wherein the combustion chamber window of the coupling optic itself is developed as a lens.

34. The internal combustion engine according to claim 30, wherein the combustion chamber window of the coupling optic itself is developed as a lens.

35. The internal combustion engine according to claim 31, wherein the combustion chamber window of the coupling optic itself is developed as a lens.

36. The internal combustion engine according to claim 32, wherein the combustion chamber window of the coupling optic itself is developed as a lens.

37. The internal combustion engine according to claim 29, wherein the combustion chamber window is made of sapphire.

38. The internal combustion engine according to claim 30, wherein the combustion chamber window is made of sapphire.

39. The internal combustion engine according to claim 31, wherein the combustion chamber window is made of sapphire.

40. The internal combustion engine according to claim 32, wherein the combustion chamber window is made of sapphire.

41. The internal combustion engine according to claim 1, wherein for the time-controlled external ignition, at least one laser light source, at least one optical transmission apparatus and at least one coupling optic for the focusing of laser light into a combustion chamber are provided, and, for the ignition of the air/fuel mixture in a cylinder, two or more laser light beams with spatially staggered focus position are provided.

42. The internal combustion engine according to claim 41, wherein two or more laser light sources are provided for every cylinder.

43. The internal combustion engine according to claim 1, wherein an electronic engine control device is provided which, according to recorded engine parameters such as the crankshaft angle (a,), the speed (n), the engine power (N), the current cylinder pressure (P,) in the combustion chamber, triggers the laser light source(s) and in so doing establishes laser light parameters such as the chronological sequence, the pulse duration and/or the ignition energy.

44. The internal combustion engine according to claim 13, wherein an electronic engine control device is provided which, according to recorded engine parameters such as the crankshaft angle (a,), the speed (n), the engine power (N), the current cylinder pressure (P,) in the combustion chamber, triggers the laser light source(s) and in so doing establishes laser light parameters such as the chronological sequence, the pulse duration and/or the ignition energy.

45. The internal combustion engine according to claim 26, wherein an electronic engine control device is provided which, according to recorded engine parameters such as the crankshaft angle (a,), the speed (n), the engine power (N), the current cylinder pressure (P,) in the combustion chamber, triggers the laser light source(s) and in so doing establishes laser light parameters such as the chronological sequence, the pulse duration and/or the ignition energy.

46. The internal combustion engine according to claim 27, wherein an electronic engine control device is provided which, according to recorded engine parameters such as the crankshaft angle (a,), the speed (n), the engine power (N), the current cylinder pressure (P,) in the combustion chamber, triggers the laser light source(s) and in so doing establishes laser light parameters such as the chronological sequence, the pulse duration and/or the ignition energy.

47. The internal combustion engine according to claim 1, wherein the air/fuel mixture is ignited by at least two chronologically successive laser light pulses per working cycle of a cylinder.

48. The internal combustion engine according to claim 13, wherein the air/fuel mixture is ignited by at least two chronologically successive laser light pulses per working cycle of a cylinder.

49. The internal combustion engine according to claim 26, wherein the air/fuel mixture is ignited by at least two chronologically successive laser light pulses per working cycle of a cylinder.

50. The internal combustion engine according to claim 27, wherein the air/fuel mixture is ignited by at least two chronologically successive laser light pulses per working cycle of a cylinder.

51. An internal combustion engine with at least one cylinder, in which the combustion of a homogeneous air/fuel mixture compressed in the cylinder by a piston is initiated by a time-controlled external ignition, wherein for the time-controlled external ignition, at least one laser light source, at least one optical transmission apparatus and at least one coupling optic for the focusing of laser light into a combustion chamber are provided, and a closed-loop control apparatus is provided which adjusts the ignition energy of a second or any further laser light pulses during the same working cycle of a cylinder according to the current cylinder pressure after the first laser light pulse.

52. The internal combustion engine according to claim 1, wherein the air/fuel ratio of the air/fuel mixture is greater than 2.

53. The internal combustion engine according to claim 1, wherein a hydrocarbon or hydrocarbon mixture, gasoline, diesel oil, natural gas or propane is used as fuel.

* * * * *